US007513309B2

(12) United States Patent
Ruttley et al.

(10) Patent No.: US 7,513,309 B2
(45) Date of Patent: Apr. 7, 2009

(54) APPARATUS FOR CONNECTING UNDERWATER TUBULAR MEMBERS

(75) Inventors: David J. Ruttley, Marrero, LA (US); Harry McGraw, Lafayette, LA (US)

(73) Assignee: Deltide Fishing and Rental Tools, Inc., Harvey, LA (US)

( * ) Notice: Subject to any disclaimer, the term of this patent is extended or adjusted under 35 U.S.C. 154(b) by 400 days.

(21) Appl. No.: 11/362,385

(22) Filed: Feb. 24, 2006

(65) Prior Publication Data

US 2007/0199716 A1 Aug. 30, 2007

(51) Int. Cl.
*E21B 29/12* (2006.01)

(52) U.S. Cl. ..... 166/341; 166/338; 166/344

(58) Field of Classification Search ..... 166/338–345, 166/368, 348, 360, 367
See application file for complete search history.

(56) References Cited

U.S. PATENT DOCUMENTS 3,248,135 A * 4/1966 Meripol ..... 285/323
4,180,132 A * 12/1979 Young ..... 166/120
4,635,728 A * 1/1987 Harrington ..... 166/341
4,708,375 A * 11/1987 Sauer ..... 285/258
4,941,691 A * 7/1990 Reimert ..... 285/39
4,949,792 A * 8/1990 Rubbo et al. ..... 166/382
5,129,454 A * 7/1992 Telfer ..... 166/120
5,228,724 A * 7/1993 Godeau ..... 285/93
5,607,190 A * 3/1997 Exandier et al. ..... 285/93
6,691,788 B1 * 2/2004 Dearing ..... 166/382
6,715,560 B2 * 4/2004 Mireles et al. ..... 166/387

* cited by examiner

*Primary Examiner*—Thomas A Beach
*Assistant Examiner*—Matthew R Buck
(74) *Attorney, Agent, or Firm*—Keaty Professional Law Corporation

(57) ABSTRACT

A connector for severed pipes in a wellbore has an elongated tubular mandrel, a sealing pack-off ring mounted on the mandrel, an activator ring for pressing against the pack-off ring and causing the pack-off ring to seal an interior of a casing above a shut-off valve. A grapple member is slidable mounted on the mandrel above the activator ring; the grapple member has an enlarged diameter plate, which rests on an upper edge of a severed casing. A production pipe, control lines and production casing can be lowered through the large opening in the mandrel and re-establish connection with the severed casing and production pipes.

4 Claims, 5 Drawing Sheets

APPARATUS FOR CONNECTING UNDERWATER TUBULAR MEMBERS

BACKGROUND OF THE INVENTION

This invention relates to connection of underwater flow lines and other tubular members without the use of divers.

Oil and gas industries develop production lines in deep-sea locations, with the tubular members extending hundreds of feet below the water surface. When a catastrophic event occurs, such as a hurricane, the tubular members become bent, damaged and sometimes broken. The depth of the location where the tubular members are broken off is often determined by either the bottom structure, the depth of the water, the height of the waves during the storm, the type of platform supporting the production and other variables that cannot be fully predicted and estimated.

Conventionally, when a well falls over the divers are engaged to either repair and reconnect the well or plug and abandon the well. The operations involving divers are relatively expensive and time consuming. In most instances, the production tubing, as well as the casings is cut off close to the mudline at a level above the surface controlled sub surface safety valve (SCSSV). When the well is shut up at the evacuation of the personnel due to the approaching storm, the pressure is bled off and the failsafe valve that is set a minimum 100 feet below the mudline is closed. Conventionally, the shut off production tubing and the immediately surrounding casing is no longer useful for reconnecting to the production facilities. In such a case, a new well has to be drilled, with associated work of installing production tubing, casings, cementing, etc.

The present invention contemplates provision of an apparatus and method for connecting severed underwater tubular members for reestablishing production through the original production tubing.

SUMMARY OF THE INVENTION

It is, therefore, an object of the present invention to provide an apparatus for connecting underwater tubular members.

It is another object of the present invention to provide an apparatus and method for connecting underwater tubular members, such as production tubing and casing, thus repairing storm damaged production lines.

It is a further object of the present invention to provide an apparatus for connecting underwater tubular members that can be installed and made operational without the use of divers.

These and other objects of the present invention are achieved through a provision of an apparatus for connecting tubular members in a wellbore, which comprises an elongated tubular mandrel configured for positioning inside of a tubular member in the wellbore. The tubular member may be a casing, a production pipe, or a combination thereof. An activator ring member is slidably mounted on the mandrel, the activator ring member being provided with a lower generally cylindrical portion and an upper frustoconical portion.

A grapple member is slidably mounted on the mandrel above the activator ring, the grapple member comprising an enlarged diameter plate configured for resting on a top edge of the tubular member inside the wellbore. The grapple member has a plurality of downwardly extending tensioned hooks that have lower parts carrying exterior teeth and inner serrations formed on outwardly inner slanting surfaces. The inner serrations mesh with matching teeth formed on the frustoconical surface of the activator ring when the tool is in a set position in the wellbore. The outer teeth of the grapple hooks are oriented upwardly; they engage the inner surface of the tubular member and resist an upward movement of the mandrel.

A flexible resilient pack-off ring is mounted below the activator ring and rests on a lower stop ring, which fixedly attached to the mandrel. When a downward force is applied to the activator ring, the force is transferred to the pack-off ring and causes the pack-off ring to expand laterally and seal the interior of the tubular member.

A connector is detachably secured to an upper end of the mandrel. An extension tubular member is secured to the free end of the connector, thus moving into the wellbore when the connector apparatus is lowered into the wellbore.

The method of connecting the tubular members of the present invention allows a severed mineral production pipe to be connected with an extension pipe that is lowered from the surface through the extension tubular member and wide central opening extending through the mandrel of the connector apparatus.

BRIEF DESCRIPTION OF THE DRAWINGS

Reference will now be made to the drawings, wherein like parts are designated by like numerals and wherein.

DETAILED DESCRIPTION OF THE PREFERRED EMBODIMENT

Figure 1:
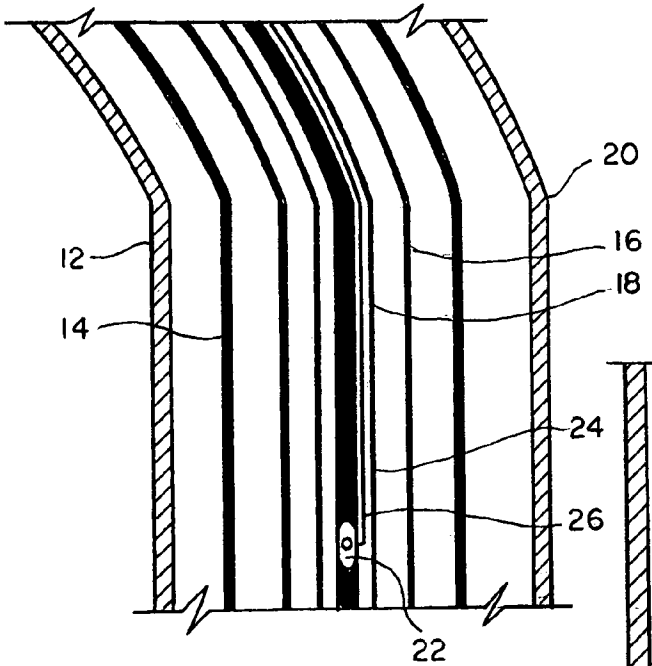
FIG. 1 is a schematic view illustrating the storm damaged tubular members of a tubular production line.

Turning now to the drawings in more detail, FIG. 1 schematically illustrates the condition of tubular members following a major storm. As can be seen in the drawing, the larger outside casing 12, the intermediate casing 14, the inner casing 16, as well as the production casing 18 are all bent at a level designated by numeral 20 in FIG. 1. At that time, the surface control sub surface safety valve 22 had shut off the flow of fluid through the production tubing 24. The production tubing 24 is also bent and out of shape, potentially damaged above the surface control sub surface safety valve 22 and cannot be used in such condition to re-establish mineral production. The control line 26 is also out of shape and cannot be used to control operation of the valve 22.

The operator of the production facility has a choice of either cutting the exterior casings in a "wedding cake" manner, with the staggered height of the outer cemented casings to allow access to the undamaged portion of the inner casing or to sever all the casings and the production tubing along the same line by using a cutting device, such as a guillotine saw. The latter method is less expensive and therefore more frequently used by the well operators. The present invention is believed to be particularly useful in re-establishing the wells, where the tubular members have been cut at the generally similar horizontal level below the water line.

Figure 2:
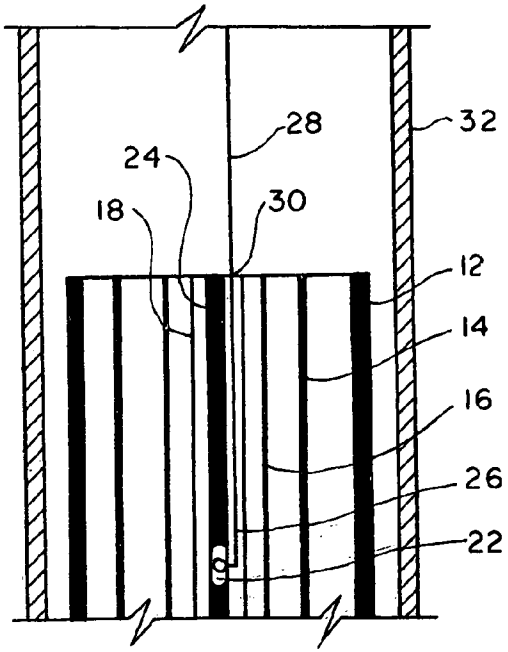
FIG. 2 is a schematic illustration of the tubular members severed below the damaged portion with a new drive pipe positioned over the existing casing.

Following the severing of the tubing method, the casings 12, 14, 16, and 18 are cut at about the same level as schematically shown in FIG. 2. The operator then establishes a new control line 28 using a control line tieback 30. A new outer casing 32 is driven into the soil of the sub sea location, with the new drive pipe 32 having an internal diameter at least slightly greater than the diameter of the existing outer casing 12. Once the new drive pipe 32 is positioned in place, the connector apparatus of the present invention can be positioned within the space defined by the new outer casing 32.

As can be seen in FIG. 6-15, the connector apparatus of the present invention comprises an elongated tubular mandrel 42 having a top sub 44, which serves as a connector member between the mandrel 42 and a new casing 46, which is lowered from the surface into the underwater location. The mandrel body 42 is provided with a plurality of hinged J-shaped latch lugs 48, which assist in alignment of the grapple hooks, which are described below. The J-lugs 48 are caught behind the hooks of the grapple member. The lugs 48 can be used for an optional retrieval of the grapple member by twisting the mandrel 42 and causing the lugs 48 to fall into the apex of the grapple hooks, thereby allowing the grapple hooks to be pulled from the wedged position, and hence remove the entire connector apparatus 40 from the well bore.

A lower stop ring 50 is welded to the mandrel 42. The ring 50 has an exterior diameter greater than the exterior diameter of the mandrel 42. The bottom of the mandrel 42 may be cut at an angle, with the bottom surface 52 assisting in guiding the connector apparatus into the tubular casing. If desired, the slanted edge 52 can be provided with serrations or teeth 53 to further assist in guiding of the mandrel 42 into the casing 16. A flexible, resilient sealing means, or pack off element 54 is slidably positioned on the mandrel 42. The bottom of the pack off element 54 rests on the ring 50, which prevents downward movement of the pack off element 54 along the mandrel body 42.

Figure 12:
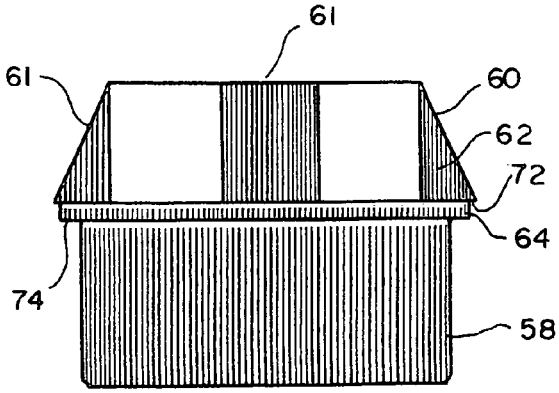
FIG. 12 is a detail view illustrating one embodiment of the activator ring.
Figure 13:
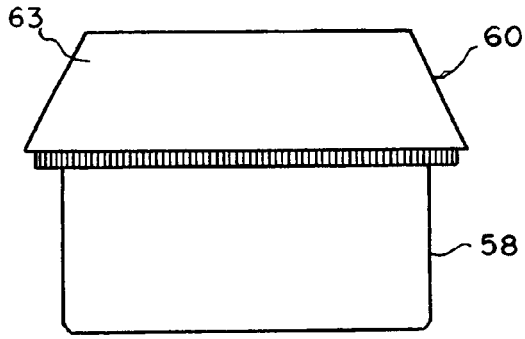
FIG. 13 is a front view illustrating an optional activator ring design.
Figure 14:
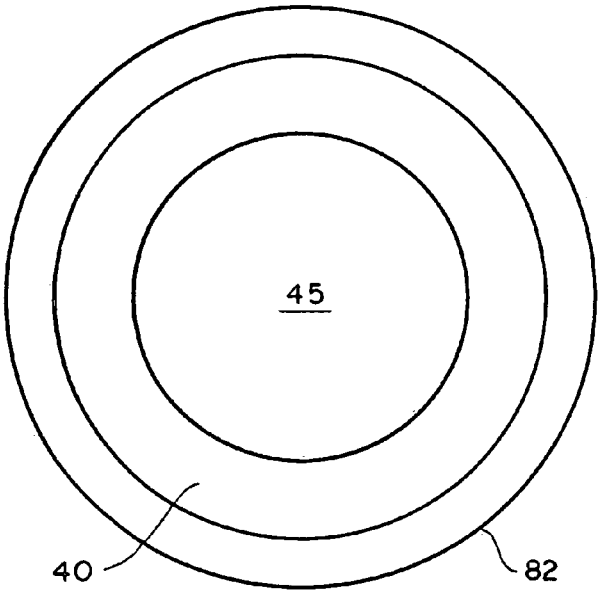
FIG. 14 is a top view of the top connector body showing a large internal diameter opening.

An activator ring 56 is positioned above the pack off element 54. The activator ring 56 has a cylindrical bottom portion 58 and a frustoconical upper portion 60. The frustoconical portion 60 can be made comprising spaced prongs 61 having a wedge-shaped cross-section, as shown in FIG. 12, or a solid surface conical member 63, as shown in FIG. 13. An exterior surface of the prongs 61 and member 63 is provided with a plurality of spaced teeth 62 which are adapted to mesh with the inner teeth 68 of the grapple hooks 70.

Figure 6:
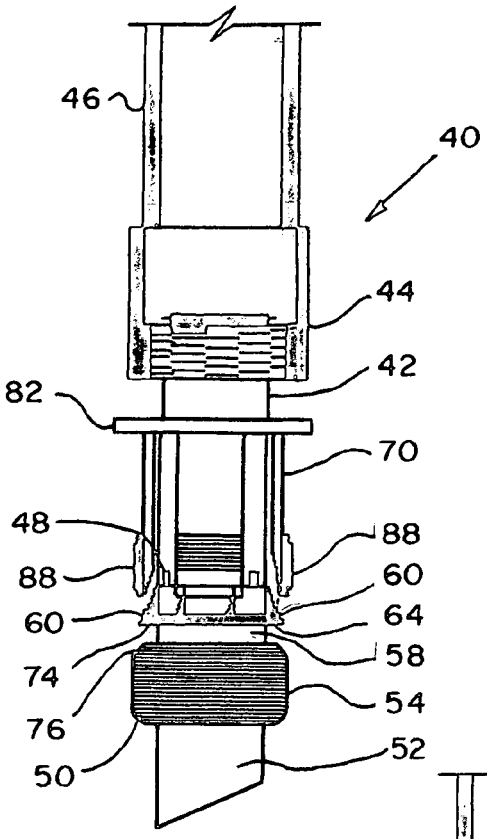
FIG. 6 is a perspective view of the apparatus of the present invention illustrating the connector apparatus in a run-in position.

Secured between a bottom surface 72 of the portion 60 or member 63 and the top of the cylindrical portion 58 is an annular flange 64, which has a diameter greater than the exterior diameter of the cylindrical portion 58. The flange 64 has an exterior diameter substantially equal to or slightly smaller than the diameter of the bottom surface 72 of the portion 60 or 63. The flange 64 defines an annular shoulder 74, which contacts an upper surface 76 of the pack off element 54. The cylindrical portion 58 fits inside the ring shaped flexible pack off element 54 as shown in FIG. 6. In the run in position, illustrated in FIG. 6, the flange 64 is located above the top surface 76, while the grapple hooks 70 are located above the portion 60. In this position, the grapple hooks 70 and the activator ring 56 are not engaged.

Figure 15:
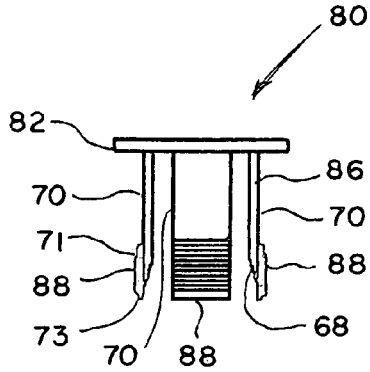
FIG. 15 is a detail view illustrating a grapple of the connector apparatus of the present invention.

As shown in more detail FIG. 15, the grapple member 80 is provided with a plurality of tensioned grapple hooks 70 secured to a ring shaped plate 82. The grapple hooks 70 extend downwardly from the plate 82 in an equidistant relationship to each other; the grapple hooks 70 have outwardly extending lower parts 71 that may have narrow angularly-shaped bottom edges 73. The grapple member 80 can have three or more grapple hooks 70. In the embodiment shown in FIG. 3-15, four grapple hooks 70 are used, with three of them shown in the drawings.

Each grapple hook 70 has an elongated body 86 which is provided with a plurality of spaced exterior teeth 88 in the lower part thereof. Each of the lower parts 71 have slanted inner surfaces 75, slanted away from the center of the grapple member 80. The inclined surfaces 75 match the angle of the inclined surfaces 60, 63 of the activator ring 56. The inner teeth 68 are formed on the inclined surfaces 75.

The teeth 88 are oriented in an upward direction so as not to resist downward movement of the connector apparatus 40, while resisting upward movement of the connector apparatus 40. When the mandrel 42 is pulled upwardly, the teeth 88 engage the inner wall of the casing 16. In the run-in position shown in FIG. 6, the grapple member 80 moves through the casing 18 without contacting the wall of the casing to enable the grapple hooks 70 to slide into the casing 18, while frictionally engaging the wall of the casing 16. At such time, the pack off element 54 is in a retracted position.

Figure 3:
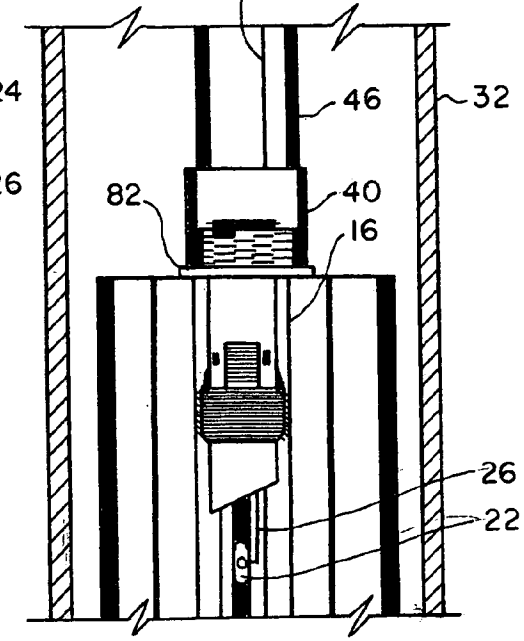
FIG. 3 is a schematic view illustrating positioning of the apparatus of the present invention resting on a casing stub.
Figure 7:
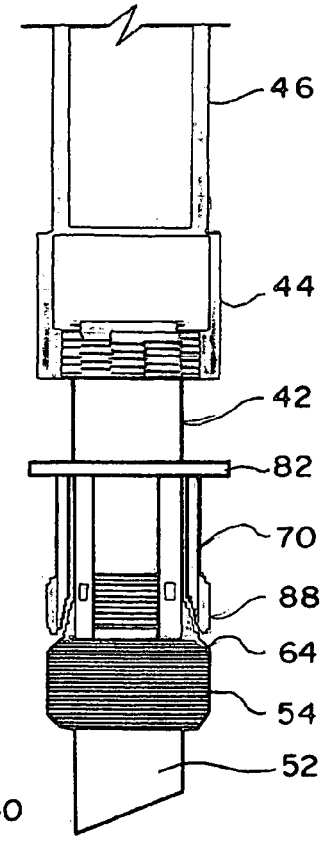
FIG. 7 is a perspective view of the apparatus of the present invention with the connector apparatus in a set position.

In a set position shown in FIGS. 3 and 7, the connector apparatus 40 is moved into the casing 16 with the flange 82 resting on top of the stub formed by the cut off casing 16. The pack off element 54 is pressed by the flange 64 of the activator ring 56, causing the pack-off element 54 to expand laterally and fill the space within the casing 16. In this position, the pack-off element 54 seals the interior of the casing 16 while the stop ring 50 prevents downward movement of the pack off element 54 along the mandrel 42.

As can be further seen in FIG. 3, the teeth 88 of the hooks 70 engage the inner wall of the casing 16, with the teeth 68 of the grapple member 80 engaging the teeth 62 of the activator ring 56. The new casing 46, which has been lowered with the connector apparatus 40 is positioned around the new control line 28, allowing the operator to re-establish control of the safety valve 22.

Figure 8:
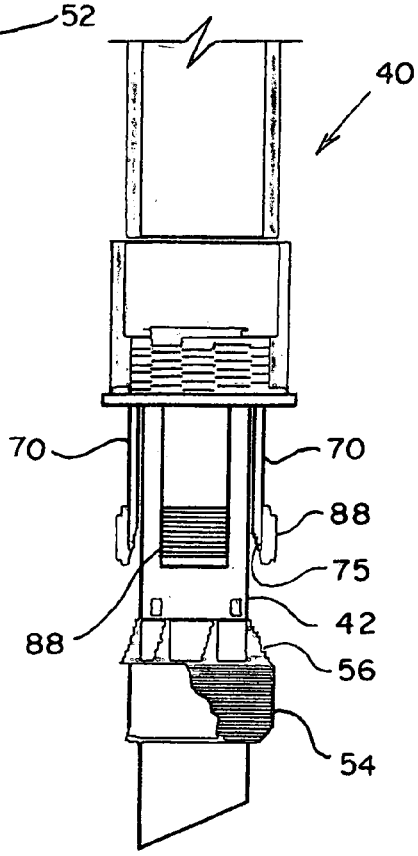
FIG. 8 is a perspective view of the apparatus of the present invention, with the connector apparatus in a release position with the pack off element engaged.
Figure 9:
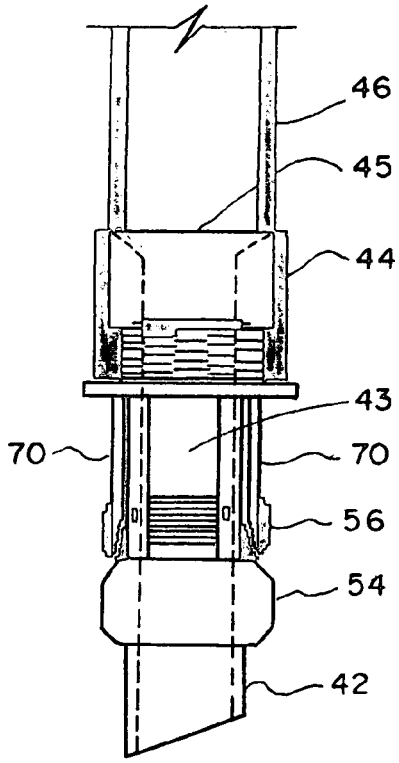
FIG. 9 is a plan view illustrating the apparatus of the present invention in a set position, with the pack off element expanded.
Figure 10:
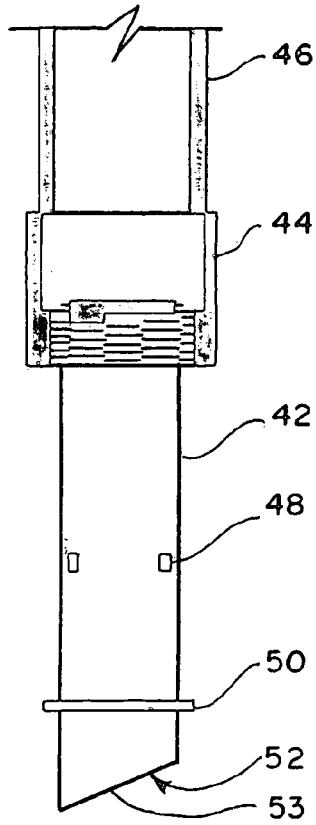
FIG. 10 is a detail view illustrating the mandrel of the connector apparatus of the present invention.
Figure 11:
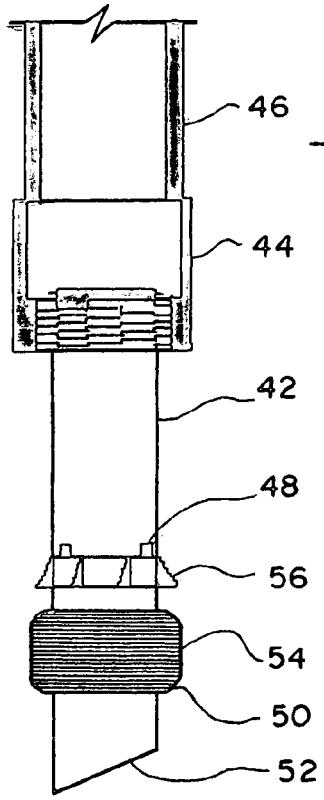
FIG. 11 is a detail view illustrating the mandrel of the connector apparatus of the present invention, with the grapple activator ring in place.

When an upwardly-directed force is applied to the connector apparatus 40, the grapple member 80 slides upwardly away from the activator ring 56 while the teeth 88 still engage the interior of the casing 16. The pack off element 54 is laterally expanded under the force created by the activator ring 56. The plate 82 contacts the bottom of the connector member 44, as shown in FIG. 8, allowing the large diameter openings 43 in the mandrel 42 and opening 45 in the connector member 44 to be used for entrance from the surface of casing strings or other equipment.

Figure 5:
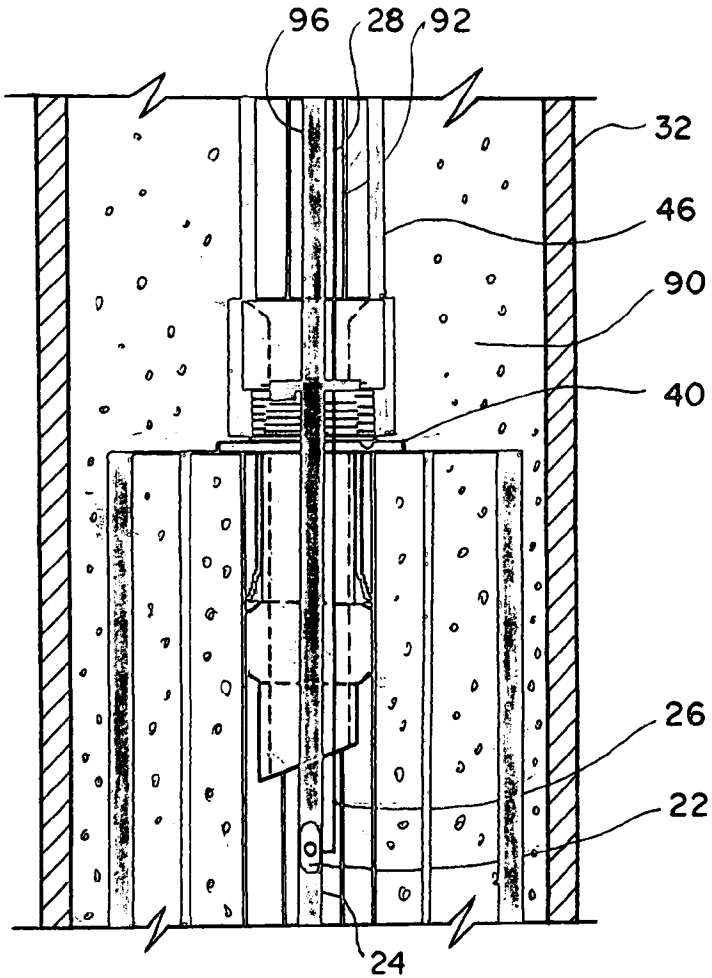
FIG. 5 is a schematic view illustrating new casing strings cemented in place around the connector apparatus of the present invention.
Figure 4:
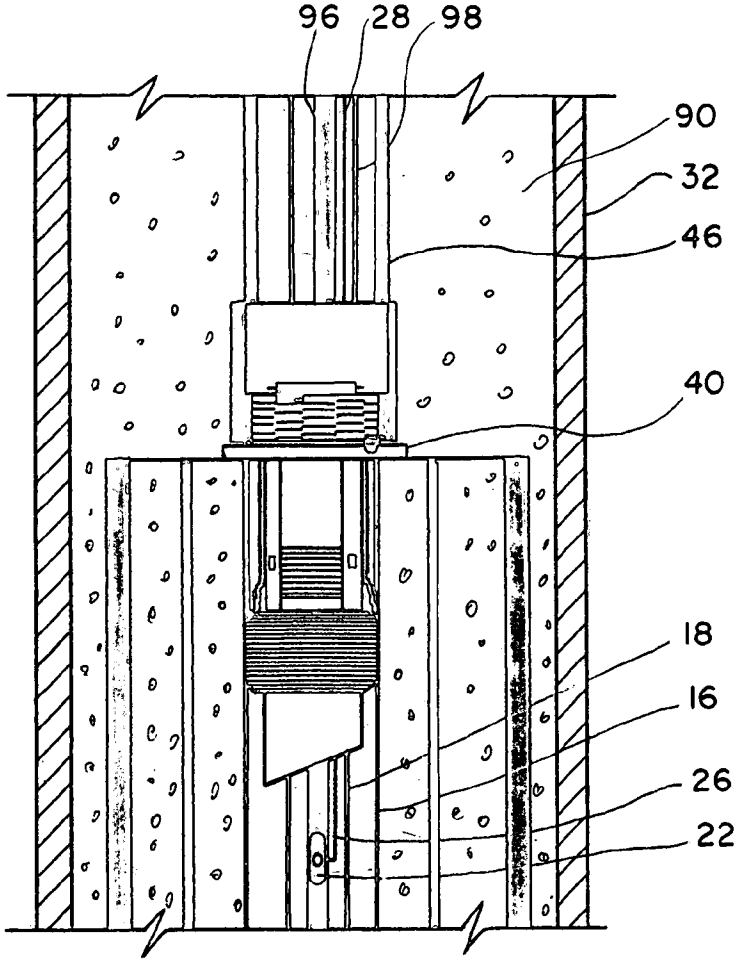
FIG. 4 is a schematic view illustrating position of the connector apparatus of the present invention with the production tubing tied back.

Once the connector member is set in place, as shown in FIG. 5, the annular space between the new casing 46 lowered along with the connector member 40 into the well is cemented, as shown by reference numeral 90, and then a new production casing 98 is lowered through the openings 45 and 43. The production tubing 24 is connected with a new production tubing string 96 lowered from the surface, and the control valve 22 is activated into an open position. The mineral production can be resumed through the same well. The production tubing as well as the control lines is tied back in a conventional manner well known in the mineral exploration industry.

The connector apparatus of the present invention can be used for repair damage to the most subterranean or subsurface locations where replacement of pipes is required. The body of the mandrel 42, grapple 80 and activator ring 56 are formed from a non-corrosive material suitable for subsurface operations. The pack-off element 54 can be made from strong resilient flexible material, such as rubber and the like. Of course, other materials can be used, provided they have similar physical characteristics.

Many changes and modifications can be made in the design of the present invention without departing from the spirit thereof. I therefore pray that my rights to the present invention be limited only by the scope of the appended claims.

We claim:

1. A method of re-establishing mineral production flow lines of an underwater wellbore, said wellbore having at least one casing and a production pipe with a shut-off valve extending through the casing, the method comprising the steps:

providing a connector apparatus comprising an elongated tubular mandrel configured for positioning inside said at least one casing in the wellbore, an activator ring member slidably mounted on the mandrel, a grapple member slidably mounted on the mandrel above the activator ring, a flexible resilient sealing ring mounted below the activator ring, said grapple member having a ring-shaped plate having an exterior diameter at least slightly greater than an exterior diameter of the casing;

severing the casing and the production pipe at a level above the shut-off valve along substantially horizontal line;

positioning a tubular member in a generally surrounding relationship over said severed casing; connecting an extension casing member to an upper end of the mandrel and lowering the mandrel and the extension casing member into the wellbore until said plate rests on an upper edge of said at least one severed casing within the wellbore;

applying a downward force on said activator ring, thereby causing lateral expansion of the sealing ring and sealing of interior of said at least one severed casing above the cut-off valve;

lowering an extension production pipe through the extension casing and the mandrel into the wellbore and connecting the extension production pipe to the severed production pipe in the wellbore; and cementing an annular space between the extension casing and the tubular member.

2. The method of claim 1, further comprising the step of providing said grapple member with a plurality of grapple hooks having upwardly oriented teeth for engaging an inner wall of said at least one casing and resisting an upward movement of the mandrel within said at least one severed casing.

3. The method of claim 2, further comprising the step of providing said grapple hooks with an inclined inner surface and providing serrations on said inner surface.

4. The method of claim 3, further comprising the steps of providing said activator ring with a frustoconical upper portion carrying a plurality of teeth and causing the teeth of the upper portion engage the serrations of the grapple hooks when the connector apparatus is in a set position.

* * * * *